US007428778B2

(12) United States Patent
Milesi et al.

(10) Patent No.: US 7,428,778 B2
(45) Date of Patent: Sep. 30, 2008

(54) METHOD AND A SYSTEM FOR INSERTING ELEMENTS IN THE GROUND, A DATA RECORDING MEDIUM FOR THE METHOD

(75) Inventors: Nicolas Milesi, Paris (FR); Ian Robertson, Andresy (FR)

(73) Assignee: Alstom Transport SA, Levallois-Perret (FR)

( * ) Notice: Subject to any disclaimer, the term of this patent is extended or adjusted under 35 U.S.C. 154(b) by 29 days.

(21) Appl. No.: 11/710,012

(22) Filed: Feb. 23, 2007

(65) Prior Publication Data

US 2007/0201161 A1 Aug. 30, 2007

(30) Foreign Application Priority Data

Feb. 23, 2006 (FR) ..... 06 01595

(51) Int. Cl.
*G01C 15/02* (2006.01)

(52) U.S. Cl. ..... 33/1 G; 33/1 Q

(58) Field of Classification Search ..... 33/1 G, 33/1 H, 1 Q, 613, 624, 645
See application file for complete search history.

(56) References Cited

U.S. PATENT DOCUMENTS 6,505,406 B2 1/2003 Robertson et al.
7,325,316 B2 * 2/2008 Milesi ..... 33/1 Q
2002/0014015 A1 * 2/2002 Robertson et al. ..... 33/1 G
2007/0251107 A1 * 11/2007 Milesi ..... 33/1 G

FOREIGN PATENT DOCUMENTS

EP 0 803 609 A2 10/1997
EP 1 178 153 A1 2/2002

* cited by examiner

*Primary Examiner*—G. Bradley Bennett
(74) *Attorney, Agent, or Firm*—Davidson, Davidson & Kappel LLC

(57) ABSTRACT

A method of inserting a preceding element and then a following element in the ground, along a calculated path, in order to construct a work, the method including: a step of determining an absolute positioning error of a preceding element relative to the nominal position at which the preceding element ought to have been inserted; and a step of automatically guiding the inserter arm towards a target position at which a following element is to be inserted as a function of the absolute positioning error determined for the preceding element in such a manner as to reduce the positioning error of the following element relative to the preceding element.

11 Claims, 3 Drawing Sheets

METHOD AND A SYSTEM FOR INSERTING ELEMENTS IN THE GROUND, A DATA RECORDING MEDIUM FOR THE METHOD

This claims priority to the French Application Number 06 01595, filed Feb. 23, 2006, and hereby incorporated by reference herein.

The present invention relates to a method and a system for inserting elements in the ground, and to a data recording medium for the method.

BACKGROUND OF THE INVENTION

Methods exist for inserting a preceding element i−1 and then a following element i in the ground along a calculated path in order to construct a work using an inserter arm that is guided in displacement. Those prior methods comprise:

a step of establishing nominal positions at which the elements are to be inserted in the ground as a function of the calculated path; and a guidance step of automatically guiding the inserter arm towards a target position at which the following element is to be inserted as a function of the nominal position established for the following element and as a function of topographical readings.

By way of example, those methods are used for inserting base plates in concrete slabs for supporting the rails of a railway track. In particular, this is used for making railway tracks that have no ballast or no sleepers (ties). For example, such insertion methods are described in European patent applications EP 0 803 609 and EP 1 178 153.

The inserter arm must be placed above the ground with great accuracy. To do this, it is known to control the displacement of the arm as a function of topographical readings (see EP 1 178 153).

Those methods give satisfaction. In particular, they make it possible to position each element with absolute error that is small relative to the nominal position at which the element should have been inserted. The term "absolute positioning error of the element i" is used herein to mean the difference $D_{ai}$ between the position of coordinates $X_{mi}$, $Y_{mi}$, and $Z_{mi}$ at which the element i is actually inserted in the ground and the nominal position of coordinates $X_{ni}$, $Y_{ni}$, and $Z_{ni}$ that was established for the element. By way of example, existing methods make it possible to keep the absolute error within a range of ±1 millimeter (mm). It is then said that the absolute accuracy of the method is ±1 mm.

With such absolute accuracy, the relative error $D_{ri}$ between the element i−1 and the element i lies in a range that is twice as great as that which is acceptable for the absolute error. The term relative error $D_{ri}$ for the positioning between the element i−1 and the element i is used to mean the difference between the absolute error $D_{ai}$ in the positioning of the element i and the absolute error $D_{ai-1}$ in the positioning of the element i−1.

With railway tracks, the absolute error is kept within bounds so as to ensure that the passengers of the train cannot feel troublesome vibration. Existing methods enable that objective to be achieved.

Nevertheless, in existing methods, nothing is done to reduce relative positioning error. Thus, in an extreme case, the following situation could occur. The element i−1 presents an absolute error of +1 mm in one direction and the element i presents an absolute error of −1 mm in the same direction. Each of these two absolute errors lies within the range of absolute errors that are acceptable. Nevertheless, under such conditions, the relative error $D_{ri}$ is equal to 2 mm, which may be considered as being unacceptable, since for example that might lead to troublesome vibration for passengers.

It is therefore desirable to reduce the relative error.

OBJECT AND SUMMARY OF THE INVENTION

The invention seeks to satisfy this desire by proposing a method of inserting elements in the ground that enables the relative positioning error of said element to be reduced.

The invention thus provides a method of inserting a preceding element and then a following element in the ground, in which the method further comprises:

a step of determining an absolute error in the positioning of the preceding element relative to the nominal position at which the preceding element ought to have been inserted; and the step of automatically guiding the inserter arm towards a target position at which the following element is to be inserted is also performed as a function of the absolute positioning error determined for the preceding element so as to reduce the positioning element of the following element relative to the preceding element.

In the above method, the fact of taking account of the absolute error in the positioning of the preceding element while guiding the inserter arm towards the target position at which the following element is to be inserted serves to reduce the positioning error of said following element relative to the preceding element.

Implementations of this method may also include one or more of the following characteristics:

the method includes a step of calculating the target position by adding half of the absolute positioning error of the preceding element in a given direction to at least one coordinate of the nominal position in that direction;

an operation of measuring the position at which the inserter arm inserts the preceding element in the ground, said measurement being performed by a measurement station positioned on a survey mark; and an operation of subtracting the measured position from the nominal position established for the preceding element;

the guidance step is also performed as a function of measurements made of the position of the inserter arm:

by a first measurement station placed on a first survey mark while the arm is moving along a first section of the calculated path; and by a second measurement station placed on a second survey mark remote from the first mark, while the inserter arm travels along a second section of the calculated path;

and in which the method further comprises:

a step of estimating the dimensional difference between the coordinates of the position of the inserter arm obtained from the measurements of the first station and the coordinates for the same position of the inserter arm obtained from the measurements of the second station; and during the guidance step, the inserter arm is guided towards the target position also as a function of said estimated difference so as to reduce the positioning error of the following element relative to the preceding error on going from the first section towards the second section;

the estimated difference is used to guide the inserter arm at least while inserting the n first successive elements along the second section where n is an integer greater than or equal to ten;

the method further comprises a step of calculating the target positions of the n first successive elements of the second section by adding the error estimated in a given direction divided by n to at least one of the coordinates of the nominal position in that direction; and the elements inserted in the ground are railway track base plates.

These implementations of the method also present the following advantages:

calculating the target position by adding half the absolute positioning error of the preceding element to the nominal position serves to minimize the relative positioning error;

guiding the inserter arm towards the target position as a function of the estimated difference between the measurements made with the help of the first and second measurement stations makes it possible, for example, to maintain the relative positioning error of the following element relative to the preceding element within an acceptable range on passing between the first and second sections of the calculated path; and guiding the inserter arm as a function of the estimated difference while inserting at least the first ten successive elements along the second section enables said estimated difference to be absorbed progressively while keeping positioning errors within an acceptable range.

The invention also provides a data recording medium having instructions for executing the above method when those instructions are executed by an electronic computer.

The invention also provides a system for inserting a preceding element and then a following element in the ground along a calculated path in order to construct a work, the system comprising:

an inserter arm that is guided in displacement, the arm being suitable for inserting the elements in the ground;

at least one measurement station positioned on a first survey mark, said station being suitable for measuring the position of the inserter arm; and a unit for guiding displacements of the inserter arm as a function of topographical readings and as a function of the calculated path.

The guide unit is suitable for executing the above insertion method.

BRIEF DESCRIPTION OF THE DRAWINGS

The invention can be better understood on reading the following description given purely by way of non-limiting example and made with reference to the accompanying drawings, in which.

MORE DETAILED DESCRIPTION

Figure 1:
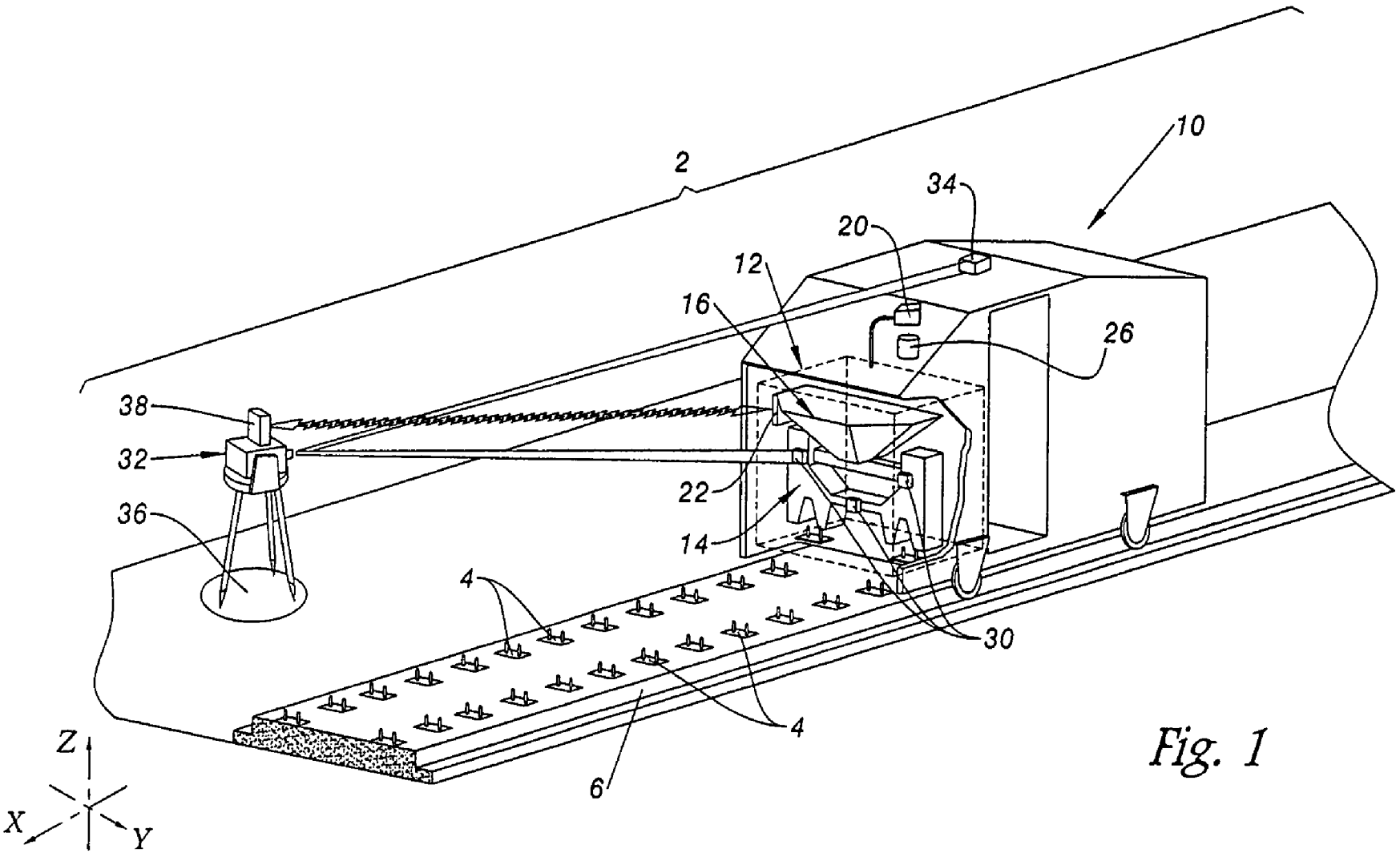
FIG. 1 is a diagrammatic perspective view of a system for inserting base plates for constructing a railway track.

FIG. 1 shows a system 2 for inserting base plates 4 in a concrete slab 6.

In the description below, the characteristics and functions that are well known to the person skilled in the art are not described in detail.

The system 2 comprises a vehicle 10 for transporting a controllable device 12 for inserting base plates 4. The vehicle 10 is mounted on four wheels, two of which are steerable and the other two of which are drive wheels enabling the vehicle to move under its own power in a given direction. The vehicle 10 has a rear face on which the device 12 is secured without any degree of freedom.

The device 12 comprises a base plate inserter arm 14 and a controllable mechanism 16 for positioning the arm 14 relative to the top surface of the concrete slab 6.

The arm 14 is suitable for inserting two base plates 14 simultaneously in the slab 6, providing it has not yet hardened. For this purpose, the arm 14 is suitable for implementing the insertion method described in European patent application EP 0 803 609 that consists in causing the still fresh slab 6 to vibrate while the base plates are being inserted. For example, the arm 14 is generally H-shaped and supports in its bottom portion two actuators having two base plates 4 secured to their ends for insertion in the newly-laid slab 6. The arm 14 is suitable for holding the base plates 4 spaced apart from each other by a distance that corresponds to the gauge of the railway track to be installed. The arm 14 has only one degree of freedom enabling the base plate 4 to be moved along a Z axis. The Z axis is defined herein as being perpendicular to the top surface of the slab 6. An X axis parallel to the travel direction of the vehicle 10 and a Y axis perpendicular to the X and Z axes are also shown in FIG. 1. By way of example, these X, Y, and Z axes are defined relative to the vehicle 10 and they define orthogonal directions. By way of example, the arm 14 is as described in detail in European patent application EP 0 803 609.

The mechanism 16 is suitable for moving the arm 14 with six degrees of freedom, namely: three degrees of freedom in rotation about the X, Y, and Z axes, and three degrees of freedom in translation along the X, Y, and Z axes.

Figure 4:
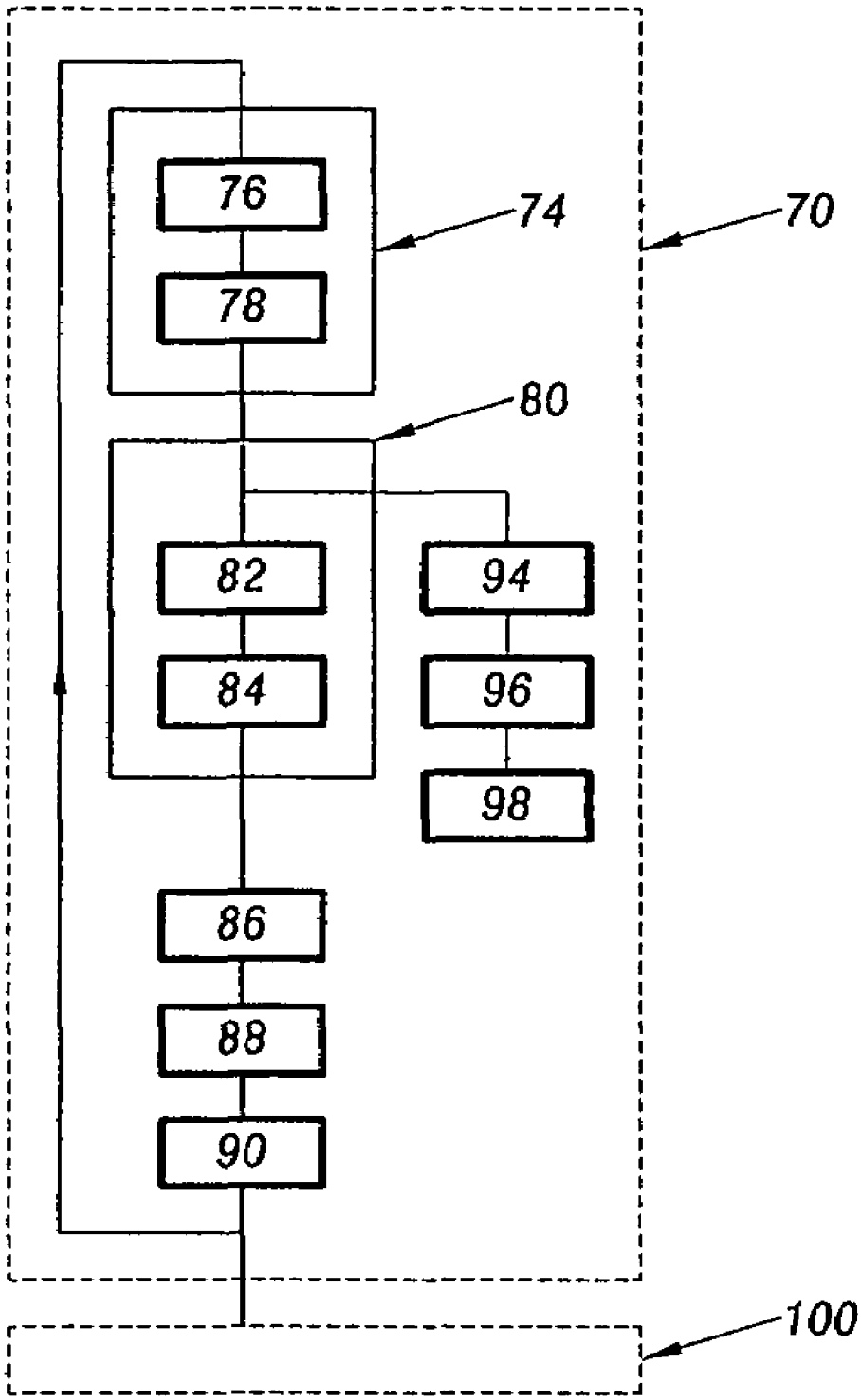
FIG. 4 is a flow chart of a method of inserting base plates with the help of the FIG. 1 system.

The vehicle 10 also includes a guide unit 20 suitable for guiding the device 12 as a function of topographical readings and of measurements received via a receiver 22. The unit 20 is also suitable for controlling the displacement of the vehicle 10. By way of example, the unit 20 is made with the help of a programmable electronic computer on board the vehicle 10 and suitable for executing the method of FIG. 4. For this purpose, the computer is connected to a recording medium 26 containing instructions for executing the method of FIG. 4 when said instructions are executed by the computer.

The arm 14 has reflectors 30 on its rear face suitable for co-operating with a measurement station 32 beside the railway track that is to be installed. For example, three reflectors 30 are secured to the arm 14. A reflector 34 is also secured to the structure of the vehicle 10. For example, the reflector 34 is mounted on the roof of the vehicle 10.

The station 32 is installed on a tripod vertically above a survey mark 36. The position of the survey mark 36 in a frame of reference associated with the earth is previously measured and known to the unit 20. The station 32 includes a laser telemeter device fitted with emitter and receiver optics enabling the distance and the angle between the station 32 and the set of reflectors 30 and 34 carried respectively by the arm 14 and by the vehicle 10 to be known with very great accuracy. The station 32 is also fitted with a radio transmitter 38 that sends the results of the measurements taken at each instant by the device 32 to the receiver 22 carried by the vehicle 10. Further details about the guide arm 14 as a function of the topographical readings and the measurements of the station 32 are given in patent application EP 1 178 153.

Figure 2:
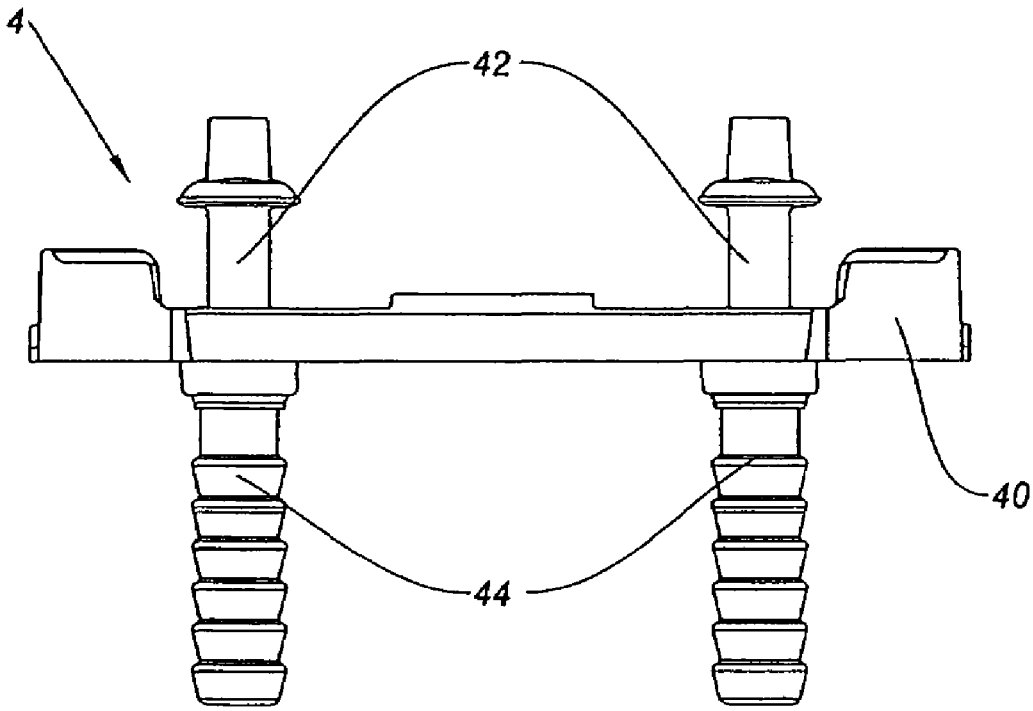
FIG. 2 is a diagrammatic view of a base plate suitable for being inserted with the help of the FIG. 1 system.

FIG. 2 shows an example of a base plate 4 that is to receive a rail and transmit the force exerted by a railway vehicle traveling on the rail to the slab 6. For this purpose, the base plate 4 comprises a plate 40 of rigid material such as cast iron, together with two anchors 42 each having a threaded rod suitable for securing a rail onto the base plate 4 by means of nuts. The base plate 4 also has two bedding rods 44 of generally cylindrical shape for being retained in the slab 6 once the slab has hardened.

Figure 3:
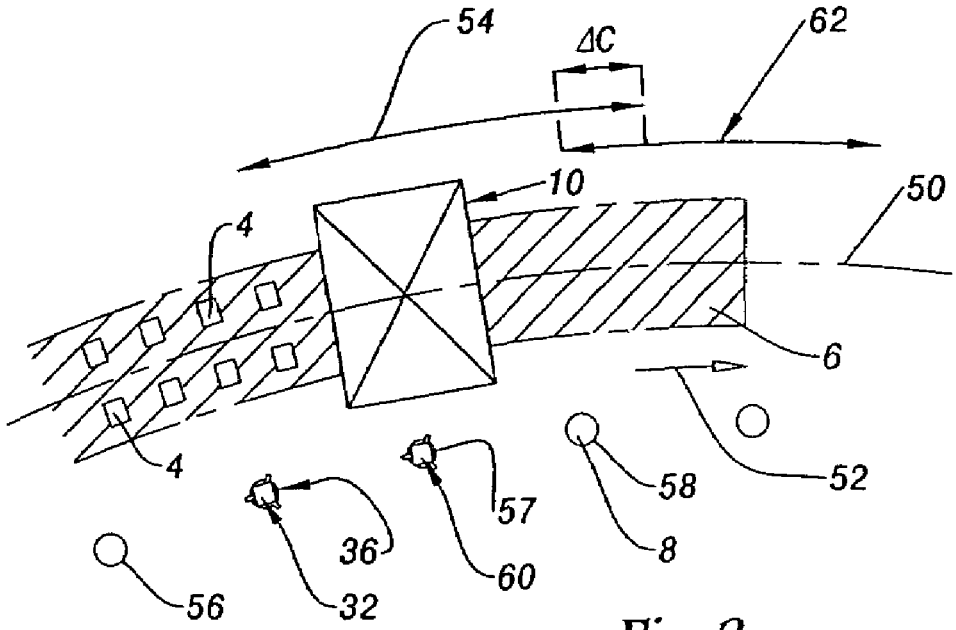
FIG. 3 is a diagrammatic plan view of the FIG. 1 system.

FIG. 3 shows the vehicle 10 as it moves along a calculated path 50. The travel direction of the vehicle 10 along the path 50 is represented by an arrow 52. In FIG. 3, elements described above with reference to FIG. 1 are given the same numerical references. The coordinates of the path 50 in the frame of reference associated with the earth are recorded in the memory 26, for example. More precisely, FIG. 3 shows a section 54 of the path 50 over which only measurements by the station 32 are used for guiding the inserter arm. Given that the range of the station 32 is limited, survey marks are provided at regular intervals along the path 50. For example, survey marks can be provided along the path 50 every 50 meters (m) to 100 m. Only three additional marks 56 to 58 are shown in this figure. The mark 57 is immediately downstream from the mark 36. Downstream is defined herein relative to the travel direction of the vehicle 10.

The system 2 also has a second station 60 for measuring the position of the arm 14 and positioned on the survey mark 57. By way of example, this station 60 is identical to the station 32 and serves to measure the position of the arm 14 as the vehicle 10 travels over a section 62 of the path 50. In the system 2, the sections 54 and 62 overlap in part over an interval ΔC. The operation of the system 2 is described below with reference to the method of FIG. 4, for the special circumstance in which the vehicle 10 is initially on the section 54 of the path 50. The method begins by a stage 70 in which use is made solely of the measurements from the station 32 for guiding the inserter arm 14.

More precisely, during a step 74, the unit 20 guides the arm 14 towards a precalculated target position in which a pair i−1 of base plates is to be inserted as a function of coordinates $X_{ci-1}$, $Y_{ci-1}$, $Z_{ci-1}$. The coordinates $X_{ci-1}$, $Y_{ci-1}$, and $Z_{ci-1}$ are calculated beforehand. The calculation of these coordinates is described below, for the particular circumstance of the coordinates $X_{ci}$, $Y_{ci}$, and $Z_{ci}$ of the target position where the following pair i of base plates is to be inserted. During step 74, the unit 20 operates in an operation 76 to cause the vehicle 10 to move along the path 50 in order to position the arm 14 close to the target position where the pair i−1 of base plates is to be inserted. Typically, at the end of the operation 76, the arm 14 is situated at the target position to within ±1 centimeter (cm).

Once the target position has been reached, during an operation 78, the unit 20 causes the mechanism 16 to position the arm 14 on the target position with greater accuracy. Typically, at the end of the operation 78, the arm 14 is situated to within ±1 mm of the target position. Once the step 74 has been completed, during a step 80, the unit 20 determines the absolute error in the positioning of the pair i−1 of base plates relative to a nominal position in which it ought to be inserted. In this case, the nominal position is represented by the coordinates $X_{ni-1}$, $Y_{ni-1}$, and $Z_{ni-1}$ for the position of the inserter arm. How the nominal coordinates are established is described in greater detail below for the particular circumstance of the coordinates $X_{ni}$, $Y_{ni}$, and $Z_{ni}$ of the nominal position for the following pair i of base plates.

More precisely, during step 80, the station 32, during an operation 82, measures the position of the arm 14 and transmits the measured position to the unit 20. During the operation 82, the unit 20 acquires the coordinates $X_{mi-1}$, $Y_{mi-1}$, and $Z_{mi-1}$ of the measured position of the arm 14. By way of example, these coordinates are expressed in a rectangular frame of reference having axes parallel to the X, Y, and Z axes and stationary relative to the mark 36. Thereafter, during an operation 84, the measured coordinates are subtracted from the coordinates $X_{ni-1}$, $Y_{ni-1}$, $Z_{ni-1}$ for the nominal position at which the pair i−1 of base plates ought theoretically to be inserted. At the end of the operation 84, the absolute error $D_{ai-1}$ in the positioning of the pair i−1 of base plates is obtained.

Thereafter, during a step 86, the pair i−1 of base plates is inserted in the fresh concrete slab 6, e.g. by implementing the method described in EP 0 803 609. During step 86, the arm 14 is held in the position measured during the operation 82. Once the pair i−1 of base plates has been inserted, during a step 88, the unit 20 establishes the coordinates $X_{ni}$, $Y_{ni}$, and $Z_{ni}$ of the nominal position at which the following pair i of base plates is to be inserted. For example, knowing the coordinates of the path 50 and a predetermined spacing between two successive pairs of base plates along said path, the unit 20 can calculate the coordinates $X_{ni}$, $Y_{ni}$, and $Z_{ni}$ for the nominal position at which the pair i of base plates ought to be inserted, in theory. In order to ensure that these coordinates can be used by the unit 20 while guiding the inserter arm, they need to be compared with the coordinates of the current position of the vehicle. This comparison can be performed only if the current coordinates of the arm or of the vehicle and the nominal coordinates are compared in a common frame of reference. In order to express these various coordinates in a common frame of reference, the topographical readings of the mark 36 and the measurements of the station 32 are used. For example, the common frame of reference is the rectangular frame of reference whose directions are colinear with the above-defined X, Y, and Z axes and having its origin fixed relative to the survey mark 36. Under such circumstances, and using the topographical readings of the mark 36, the coordinates $X_{ni}$, $Y_{ni}$, and $Z_{ni}$ are expressed in the common frame of reference. The common frame of reference is also used, for example, to express the coordinates $X_{ci}$, $Y_{ci}$, and $Z_{ci}$, as well as the coordinates $X_{ni}$, $Y_{ni}$, and $Z_{ni}$.

Thereafter, during a step 90, the unit 20 calculates the coordinates $X_{ci}$, $Y_{ci}$, and $Z_{ci}$ of the target position where the following pair i of base plates is to be inserted. These coordinates are expressed in the common frame of reference. During step 90, the target position is calculated as a function of the absolute error $D_{ai-1}$ determined during step 90. More precisely, to insert the n first pairs of base plates in the section 54, the coordinates $X_{ci}$, $Y_{ci}$, and $Z_{ci}$ are calculated using the following relationships, for example:

$$X_{ci}=X_{ni}+(D_{x,i-1}/2)+E_x/n$$

$$Y_{ci}=Y_{ni}+(D_{y,i-1}/2)+E_y/n$$

$$Z_{ci}=Z_{ni}+(D_{z,i-1}/2)+E_z/n \quad (1)$$

where:

$D_{x,i-1}$, $D_{y,i-1}$, and $D_{z,i-1}$ are the coordinates of the absolute error $D_{ai-1}$ determined during step 80, respectively along the X, Y, and Z axes of the common frame of reference; and $E_x$, $E_y$, and $E_z$ are the coordinates, respectively along the X, Y, and Z axes of the common frame of reference of a measurement difference E between the measurements made from the station 32 and from a preceding station placed on the mark 56.

The way in which the coordinates $E_x$, $E_y$, and $E_z$ are estimated is described in greater detail below for the particular circumstance of the difference between the measurements from the stations 32 and 60. Typically, n is an integer greater than or equal to ten.

If during step 90, the following pair of base plates for insertion is not part of the n first base plates of the section, then the coordinates $X_{ci}$, $Y_{ci}$, and $Z_{ci}$ are calculated using the following relationships:

$$X_{ci}=X_{ni}+(D_{x,i-1}/2)$$

$$Y_{ci}=Y_{mi}+(D_{y,i-1}/2)$$

$$Z_{ci}=Z_{mi}+(D_{z,i-1}/2) \quad (2)$$

At the end of step 90, the method returns to step 74 to insert the following pair i of base plates.

Steps 74 to 90 are repeated in a loop so long as the arm 14 is traveling along the section 54 of the path 50. Nevertheless, when the arm 14 reaches the overlap interval ΔC, in parallel with the step 80, the station 60 acts during a step 94 to measure the position of the arm 14. The step 94 is preferably performed simultaneously with the step 82 so as to reduce errors in measuring the difference E. Thereafter, the station 60 sends the measurements it has made to the unit 20 during a step 96.

During a step 98, the unit 20 estimates the difference E between the measurements made by the station 32 and those made by the station 60. For this purpose, during the step 98, the unit 20 establishes the value of the coordinates $E_x$, $E_y$, and $E_z$ from the difference between the measurements made during steps 82 and 94 and also as a function of the topographical readings of the marks 36 and 57. It has been found that the coordinates $X_{mi}$, $Y_{mi}$, and $Z_{mi}$ obtained from measurements made by the station 32 are not strictly identical to those obtained from measurements made by the station 60. This dimensional difference E can then lead, on changing over from the section 54 to the section 62, to exceeding acceptable values for the relative error. At the end of step 98, the values $E_x$, $E_y$, and $E_z$ are stored so as to be used while inserting the n first pairs of base plates in the section 62.

When the arm 14 has traveled along all of the section 54, then the stage 70 comes to an end and a new stage 100 begins in which use is made of measurements from the station 60 only while guiding the arm 14 as it travels along the section 62. At the beginning of this stage 100, the values $E_x$, $E_y$, and $E_z$ used for calculating the coordinates of the target positions of the n first pairs for insertion are those estimated during the step 98 of the preceding stage of use. In parallel with step 100, for example, the station 32 is moved and then positioned on the mark 58 situated immediately downstream from the mark 57. Thereafter, the procedure as described for the particular circumstance of sections 54 and 62 is repeated between the section 62 and the section immediately downstream therefrom. Thus, the stages 70 and 100 are reiterated throughout the travel of the vehicle 10 along the path 50.

Numerous other implementations are possible. For example, in a variant, the stations 32 and 60 are adapted to communicate between each other the measurements they have made of a common position of the arm 14. On the basis of the measurements made by the stations 32 and 60, the station 32 and/or the station 60 corrects its own measurements in order to absorb progressively the difference E on passing from the station 54 to the section 62.

The target position can be calculated as a function of the absolute error in the positioning of the preceding pair of base plates without ever taking account of the difference E. Conversely, the teaching given herein for progressively absorbing the difference E can be implemented without correcting the target position as a function of the absolute error in the positioning of the preceding pair of base plates.

Other common frames of reference could be used, for example the common frame of reference could be stationary relative to the vehicle 10. The insertion method described herein for the particular circumstance of inserting base plates for supporting railway track can be adapted to insert any other element needed for undertaking engineering or construction work.

What is claimed is:

1. A method of inserting a preceding element and a following element in the ground along a calculated path to construct a work with help of an inserter arm guided in displacement, the method comprising:

establishing nominal positions at which the elements are to be inserted in the ground as a function of the calculated path;

automatically guiding the inserter arm towards a target position at which the following element is to be inserted as a function of the nominal position established for the following element and as a function of topographical readings; and determining an absolute positioning error in a positioning of the preceding element relative to the nominal position at which the preceding element ought to have been inserted;

the automatically guiding step also being a function of the absolute positioning error determined for the preceding element to reduce a following element positioning error of the following element relative to the preceding element.

2. The method as recited in claim 1 further comprising calculating the target position by adding half of the absolute positioning error of the preceding element in a given direction to at least one coordinate of the nominal position in that direction.

3. The method as recited in claim 1 wherein determining the absolute positioning error comprises:

measuring the position at which the inserter arm inserts the preceding element in the ground, the measuring being performed by a measurement station positioned on a mark from where the topographical readings take place; and subtracting the measured position from the nominal position established for the preceding element.

4. The method as recited in claim 1 wherein the automatically guiding step is also performed as a function of measurements of the position of the inserter arm made:

by a first measurement station placed on a first mark from where the topographical readings take place while the arm is moving along a first section of the calculated path;

by a second measurement station placed on a second mark from where the topographical readings take place while the inserter arm travels along a second section of the calculated path, the second mark being remote from the first mark;

estimating the dimensional difference between the coordinates of the position of the inserter arm obtained from the measurements of the first station and the coordinates for the same position of the inserter arm obtained from the measurements of the second station; and during the guidance step, the inserter arm is guided towards the target position also as a function of said estimated difference to reduce the positioning error of the following element relative to the preceding element on going from the first section towards the second section.

5. The method as recited in claim 4 wherein the estimated difference is used to guide the inserter arm at least while inserting the n first successive elements along the second section where n is an integer greater than or equal to ten.

6. The method as recited in claim 5 further comprising calculating the target positions of the n first successive elements of the second section by adding the error estimated in a given direction divided by n to at least one of the coordinates of the nominal position in that direction.

7. The method as recited in claim 1 wherein the elements inserted in the ground are railway track base plates.

8. A data recording medium, including instructions for executing an insertion method as recited in claim 1 wherein the instructions are executable by an electronic computer.

9. A system for inserting a preceding element and then a following element in the ground along a calculated path for constructing a work, the system comprising:

an inserter arm that is guided in displacement, the arm being suitable for inserting elements in the ground;

at least one measurement station positioned on a first mark from where topographical readings take place, the measurement station being suitable for measuring the position of the inserter arm; and a guide unit for guiding displacements of the inserter arm as a function of topographical readings and as a function of the calculated path, wherein the guide unit is suitable for executing the insertion method as recited in claim 1.

10. The system as recited in claim 9 wherein the system includes at least one second measurement station positioned on a second mark from where topographical readings take place, the second station being suitable for measuring the position of the inserter arm over a portion of the calculated path in which the position of the inserter arm can also be measured by the first measurement station.

11. The system as recited in claim 10 wherein the guide unit is suitable for executing also as a function of the measurements of the position of the inserter arm made:

by a first measurement station placed on a first mark from where the topographical readings take place while the arm is moving along a first section of the calculated path;

by a second measurement station placed on a second mark from where the topographical readings take place while the inserter arm travels along a second section of the calculated path, the second mark being remote from the first mark;

estimating the dimensional difference between the coordinates of the position of the inserter arm obtained from the measurements of the first station and the coordinates for the same position of the inserter arm obtained from the measurements of the second station; and during the guidance step, the inserter arm is guided towards the target position also as a function of said estimated difference to reduce the positioning error of the following element relative to the preceding element on going from the first section towards the second section.

* * * * *